US005369825A

United States Patent [19]

Reesby

[11] Patent Number: 5,369,825

[45] Date of Patent: Dec. 6, 1994

[54] ALL PURPOSE SURGERY TABLE

[75] Inventor: Cyril F. Reesby, Troy, Ohio

[73] Assignee: Midmark Corporation, Versailles, Ohio

[21] Appl. No.: 20,676

[22] Filed: Feb. 22, 1993

Related U.S. Application Data

[63] Continuation-in-part of Ser. No. 806,639, Dec. 13, 1991, abandoned.

[51] Int. Cl.[5] ..... A61G 7/05; A61G 7/00

[52] U.S. Cl. ..... 5/613; 5/611; 5/600

[58] Field of Search ..... 5/600, 601, 602, 611, 5/613, 618, 622; 378/209, 208; 74/137, 143, 20, 103, 140, 22

[56] References Cited

U.S. PATENT DOCUMENTS

| | | | |
|---|---|---|---|
| 1,201,274 | 10/1916 | Denquer . | |
| 2,120,732 | 1/1938 | Comper . | |
| 2,172,941 | 9/1939 | Manning | 269/209 |
| 2,257,491 | 9/1941 | Armstrong | 5/613 |
| 2,306,031 | 6/1942 | Anderson et al. | 311/5 |
| 2,605,151 | 7/1952 | Shampaine | 311/7 |
| 2,828,172 | 3/1958 | McDonald | 378/209 |
| 3,022,235 | 4/1959 | Schar | 5/611 |
| 3,257,556 | 6/1960 | Boetcker | 5/601 |
| 3,281,141 | 1/1966 | Smiley et al. | 269/325 |
| 3,411,766 | 11/1968 | Lanigan . | |
| 3,452,977 | 11/1975 | Ryman | 269/324 |
| 3,851,870 | 12/1975 | Cook | 269/322 |
| 3,868,103 | 2/1976 | Pageot | 269/325 |
| 4,034,972 | 7/1977 | Peterson | 5/618 |
| 4,148,472 | 4/1979 | Rais | 269/325 |
| 4,501,414 | 2/1985 | Mason | 269/325 |
| 4,639,954 | 2/1987 | Speed | 5/602 |
| 4,821,351 | 4/1989 | Bergenwall | 5/618 |
| 4,894,876 | 1/1990 | Fenwick | 5/602 |

OTHER PUBLICATIONS

Chicmate General Surgical Table (Brochure) by Kirschner Chick Surgical Systems.

Chick 702 Orthopedic & Surgical Operating Table (Brochure) by Kirschner Chick Orthopedic Products.

*Primary Examiner*—Flemming Saether

*Attorney, Agent, or Firm*—Biebel & French

[57] ABSTRACT

A surgical table is provided which includes a patient support portion for receiving a patient and a base member connected to and supporting the patient support portion. The patient support portion includes a seat portion and a leg support portion wherein the leg support portion is mounted for movement to a plurality of positions including a first position in which the leg support portion is coplanar with the seat portion, and a second position wherein the leg support portion is located underneath and in overlapping relationship with the seat portion.

19 Claims, 9 Drawing Sheets

ALL PURPOSE SURGERY TABLE

CROSS REFERENCE TO RELATED APPLICATION

This application is a continuation-in-part of application Ser. No. 07/806,639, filed Dec. 13, 1991, now abandoned.

BACKGROUND OF THE INVENTION

The present invention relates to surgical operating tables and, more particularly, to surgical operating tables including multiple articulated sections.

Surgical operating room tables are designed to provide a support platform for holding patients in an appropriate position during various forms of invasive and non-invasive surgery. It is often necessary for various medical personnel to gain access to the patient prior to, during or following surgery such that the surgical table must provide access to the patient from various locations along the table. Specifically, access must be provided to the patient for the performance of X-ray procedures as well as to permit the surgical team to have sufficient access whereby the personnel may stand close to the table without having their legs or feet contact the lower portions of the table. Further, the table should provide sufficient close access to help reduce the incidence of back strain resulting from the personnel reaching an excessive distance across the table.

Prior art surgical tables for use in operating rooms have included multiple sections which may be moved relative to each other in order to match the anatomical relationship of natural hinge points on the patient. Such multiple sections include a split back section to match the flexion of the thoracic spine, a split seat section for matching the flexion of the lumbar spine and a split leg section for matching the individual flexion of each of the legs.

Typical table movements for surgical tables are shown in CHICMATE sales brochures for a general surgical table produced by KIRSCHNER Chick Surgical Systems of Greenwood, S. C. This brochure illustrates a surgical table having at least four articulated sections which may be pivoted relative to each other in order to accommodate certain specialized forms of surgery including urology, gynecology, neurology, proctology and kidney surgery. This table further includes a pedestal for supporting the patient support surface wherein the pedestal provides vertical movement of the support surface.

Another surgery table is illustrated in a brochure for a CHICK 702 orthopedic and surgery operating table produced by KIRSCHNER Chick Surgical Systems of Greenwood, S. C. This table includes various support surfaces which may be moved or removed as necessary to provide the proper configuration for a particular operation being performed.

Prior art surgery tables used for urology surgery, such as the general surgical table produced by KIRSCHNER Chick Surgical Systems, include a perineal cut-out for perineal surgery. This cut-out is located adjacent to the hinge point for accommodating flexion of the knee joint, and during urology surgery the patient must be moved longitudinally along the table to place the hip portion of the patient adjacent to the cut-out area. In this position, the patient's head will be moved off of the headrest portion of the table. Once the patient is in this position, the leg support portion of the table is lowered to permit the surgeon to easily access the perineum of the patient.

Since the leg section on prior art surgical tables is designed to pivot to a location directly below the edge of the perineal cut-out, the leg support can often become an obstruction to the surgeon's knees or to equipment such as an interfacing image intensifier used during the surgery. In order to address this problem, the patient is often placed in a reverse position on the table with the patient's perineum located adjacent to the head end of the surgery table which provides an overhang area under which the surgeon's legs or equipment may be accommodated. This particular use of the table is inconvenient in that it also requires the provision of a temporary leg support which is attached extending from the head end of the surgery table. Further, in tables which include electronic controls to move the table to preprogrammed positions, the controls must be reversed in order to properly position the patient oriented in a reverse position on the table.

Another problem associated with prior art surgery tables relates to the use of the table by an anesthetist who must anesthetize a patient prior to the performance of a surgery. In particular, when a perineal surgery is to be performed, the anesthetist must first anesthetize the patient in a normal position with the head of the patient near the head end of the table, and the patient must be subsequently moved toward the foot end whereby the perineum of the patient is positioned over a perineal cut-out of the table. For this type of surgery, the patient's head is initially positioned on the headrest of the table in order to permit the patient's head to be pivoted downwardly whereby the patient's trachea is straightened for intubation by the anesthetist. Prior art tables do not typically provide an articulated section at the proper location to permit intubation to be performed while also simultaneously positioning the perineum of the patient over a perineal cut-out for the table.

Accordingly, there is a need for a surgical table in which the patient's head may be located on the headrest during all forms of operation while also facilitating access of medical personnel to critical locations on the patient. Further, there is a need for such a surgical table in which no sections of the table need be removed in order to accommodate the various surgical specialties.

SUMMARY OF THE INVENTION

The present invention provides a surgery table including a patient support portion for receiving a patient and a base member connected to and supporting the patient support portion.

The patient support portion includes a seat portion which defines opposing ends thereof and which includes a substantially planar upper surface. The patient support portion also includes a leg portion having a substantially planar upper surface mounted adjacent to one end of the seat portion. The leg portion is mounted for movement to a plurality of positions including a first position in which the upper surface of the leg portion lies in a common plane with the upper surface of the seat portion, and a second position in which the upper surface of the leg portion lies in a plane substantially parallel to and located below a plane defined by the seat portion.

In addition, the seat portion is mounted for movement relative to the base member in a direction parallel to the upper surface of the seat portion when the leg portion is in the second position such that a perineal cut-out of the seat portion may be moved to extend away from the base member and the leg portion. Thus, the seat portion will form an outwardly extending ledge which permits the surgeon's legs or necessary equipment to be positioned underneath the seat portion during an operation on the patient's perineum.

The leg portion preferably includes first and second sections which are connected to each other for pivotal relative movement. In preparing the surgery table for a lithotomy operation, the leg portion is initially moved vertically to a plane located beneath the seat portion of the table. The first leg section is then positioned underneath the seat portion of the table and the second leg section is pivoted downwardly until it is oriented substantially perpendicular to the first seat section and adjacent to the base. Finally, the seat portion is moved in a horizontal plane forwardly until the forward edge of the seat portion extends a substantial distance beyond the second section of the leg portion.

Alternatively, instead of moving the seat portion forwardly after positioning the first section underneath the seat portion, the seat portion and first leg section may be pivoted with the head portion moving downwardly to form a jack knife or trendelenburg position for the table. In this position, proctology procedures or laminectomies may be performed.

The table is also provided with sufficient articulated joints to permit the table to be moved to flex and reflex positions for the performance of kidney and thoracic operations, as well as to a sitting position for the performance of plastic and neurology operations.

Other objects and advantages of the invention will be apparent from the following description, the accompanying drawings, and the appended claims.

DETAILED DESCRIPTION OF THE PREFERRED EMBODIMENT

Figure 1:
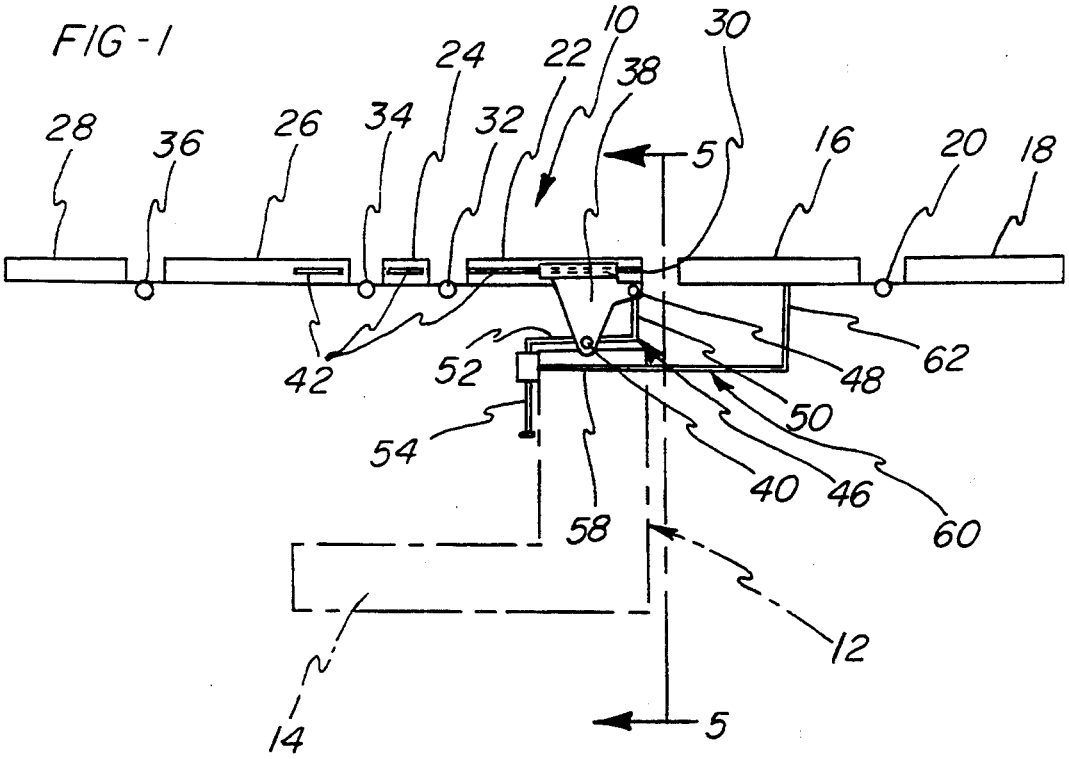
FIG. 1 is a diagrammatic elevational view of the surgery table of the present invention configured to support a patient in a supine position.

Referring initially FIGS. 1–4, the surgery table of the present invention includes a patient support portion 10 and a base member 12 for supporting the patient support portion 10. The base member 12 preferably includes an elongated lower section 14 and may include casters (not shown) for facilitating movement of the table to a desired location.

The patient support portion 10 includes a leg portion formed by a first thigh supporting section 16 and a second tibial supporting section 18. The first and second leg sections 16, 18 are preferably connected to each other by a conventional pivot connection 20 whereby the second section 18 may move in pivotal movement relative to the first section 16.

The patient support portion 10 further includes a seat portion formed by a seat section 22 and a kidney elevator section 24, as well as a back portion including a back section 26 and a head rest or support section 28 located adjacent to the seat portion of the patient support portion 10.

Figure 2:
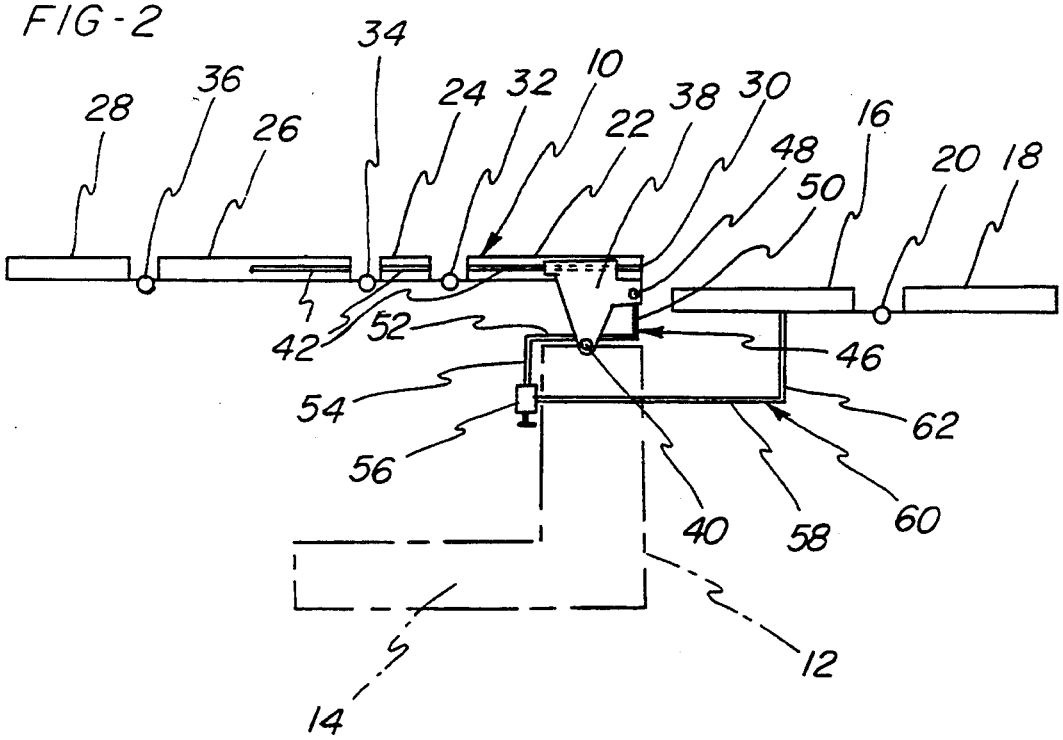
FIG. 2 is a diagrammatic elevational view showing the leg portion in a vertically lowered position parallel to the seat portion of the table.

The improvement which the present invention provides over the prior art resides in providing a unique movement for storing the leg sections 16, 18 underneath the seat portion and moving the seat and back portions forwardly to provide an open gap under a forward edge 30 of the seat section 22. This is illustrated in FIGS. 1–4 wherein FIG. 2 shows that the leg sections 16, 18 may be moved vertically downwardly such that a plane defined by the upper surface of the leg portion is located below a plane defined by the seat section 22.

Figure 3:
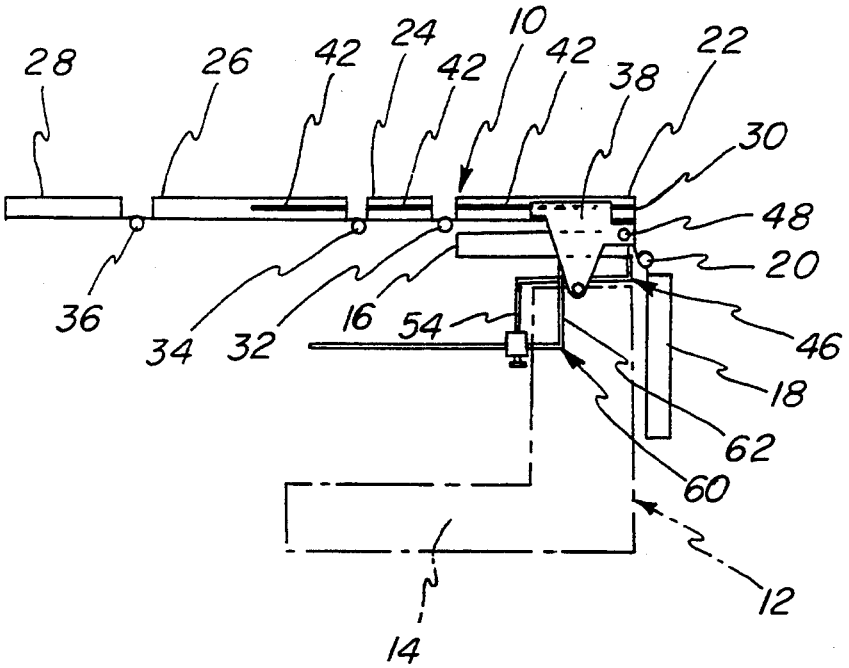
FIG. 3, is an elevational diagrammatic view showing the first section of the leg portion located under the seat portion.

As shown in FIG. 3, the first leg section 16 is then moved rearwardly to a position directly underneath the seat section 22 whereby the seat section 22 overlaps the first leg section 16. In addition, the second leg section 18 is pivoted downwardly such that it extends substantially perpendicular to the first seat section 16 and is located adjacent to the base 12.

Figure 4:
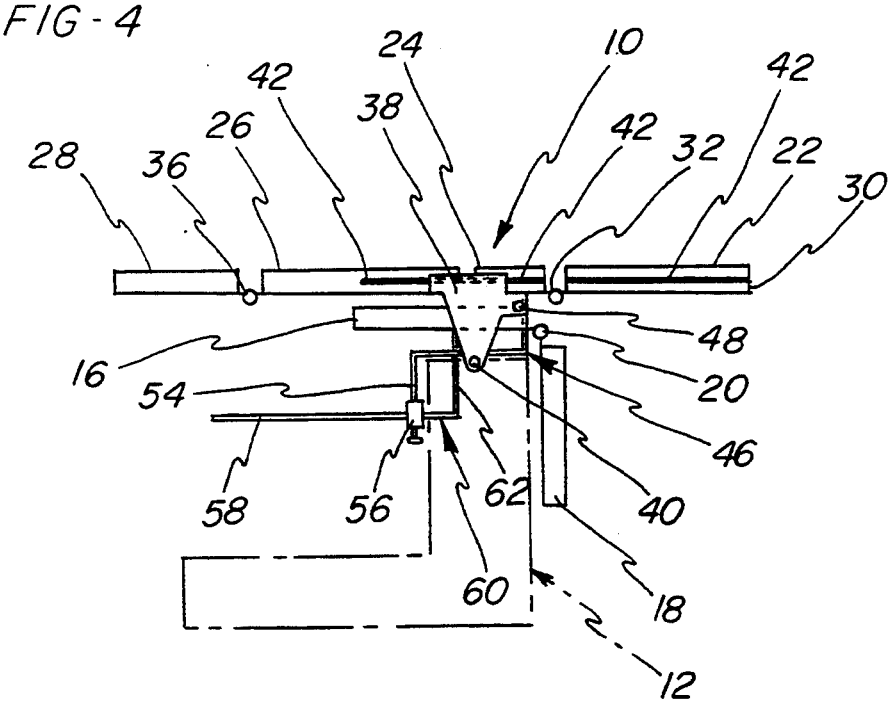
FIG. 4 is an elevational diagrammatic view showing the seat portion extended forwardly beyond the leg portion for a gynecology or urology operation.

Finally as is illustrated in FIG. 4, the seat and back sections 22, 24, 26, 28 are moved forwardly in a horizontal plane while the leg sections 16, 18 remain stationary in the position shown in FIG. 3. The seat section 22 is extended forwardly a sufficient distance to provide a gap between the forward edge 30 of the seat section 22 and the second leg section 18 such that a surgeon's legs or equipment may be received underneath the seat section 22. In the preferred embodiment, the horizontal distance between the edge 30 and the second leg section 18 is at least 20 inches.

The position of the surgery table shown in FIG. 4 is ideal for the performance of urology and gynecology procedures, and it should be noted that this particular configuration of the table permits the patient to remain in position with the head portion of the patient on the headrest 28 of the table. Thus, the patient need not be rotated on the table or moved longitudinally along the table to a position where the patient's head is no longer supported by the headrest 28.

It should be noted that the seat sections 22, 24 and back and headrest sections 26, 28 may be connected to each other by any conventional pivot means as is illustrated by pivot points 32, 34, 36. The connections provided between the various sections preferably include means for locking the sections in different positions which connections are well-known to those skilled in the art and may be similar to those disclosed in the brochures to KIRSCHNER Chick Surgical Systems mentioned above in the Background section of the present application.

Further, movement of the various sections relative to each other may be effected by either manual or automatic means as is also well-known in the art. For example, motor driven linear actuators may be used to effect pivotal movement between the sections as well as longitudinal movement of the seat and back portions.

It should also be noted that the kidney elevator section 24 may include means permitting independent vertical movement of this section, and that the headrest section may be mounted for movement in different planes and may be a replaceable unit permitting specially designed headrests to be used for specialized surgery.

In addition, various mechanisms may be incorporated in order to effect the relative movement between the leg portion and the seat portion of the present surgery table, and the mechanism may be in the form of a manually adjustable set of linkages or a mechanism which automatically moves the leg sections 16, 18 to the desired locations. It is only necessary that the particular mechanism incorporated provide the disclosed movements of the leg portion while maintaining the leg portion as an integral part of the surgery table.

A specific mechanism for moving the leg sections 16, 18 relative to the seat and back sections 22, 24, 26, 28, as well as moving the seat and back portions relative to the base member 12, is illustrated diagrammatically in FIGS. 1–5. However, it should be noted that the particular mechanism disclosed for providing the particular movements of the sections of the present table are not intended to be any way limiting to the concept of the present invention which may incorporate other mechanisms, manual or automatic to move the various sections relative to each other.

Figure 5:
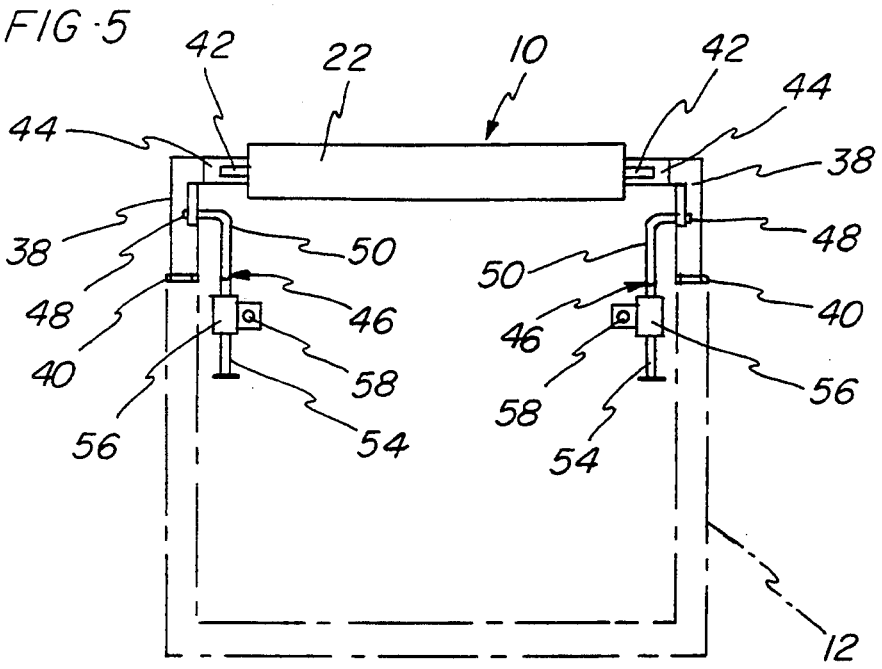
FIG. 5 is a cross-sectional view taken along line 5—5 in FIG. 1.

The patient support portion 10 may be supported on the base member 12 by means of a pair of pivot support plates 38 located on either side of the patient support portion 10. The pivot support plates 38 are attached to the base member 12 at pivot points 40 whereby the plates 38 and patient support portion 10 are permitted to pivot relative to the base member 12. Referring also to FIG. 5, the outer edges of the seat section 22, the kidney elevator section 24 and the back section 26 may be provided with laterally extending rails 42 which are adapted to be received within U-shaped recesses 44 formed within the upper portion of the plates 38. The rails 42 cooperate with the recesses 44 to permit the seat and back portions to slide horizontally relative to the plates 38 whereby the seat and back portions may move to the position illustrated in FIG. 4. In addition, means may be provided for preventing relative movement between the rails 42 and plates 38. Such locking means could be any conventional mechanism, such as rotating screws creating a friction lock or other means.

Each of the plates 38 supports a leg support pivot bar 46 and the bars 46 are each pivotally attached to respective pivot plates 38 at pivot points 48. It should be noted that the pivot points 48 may be provided with conventional means for locking the pivot bars 46 in a desired position and for releasing the bars 46 for free pivotal movement. Each of the bars 46 include a first vertical extension 50 extending from the pivot point 48, a horizontal extension 52 connected to the first vertical extension 50 and a second vertical extension 54 extending downwardly from the horizontal extension 52.

A collar member 56 is slidably mounted on each of the second vertical extensions 54, which collar members 56 are preferably provided with conventional locking means for holding the collars at a desired vertical location on the extensions 54 wherein the locking means may be released to permit repositioning of the collars 56, as desired.

The collars 56 each receive a horizontal extension 58 of a longitudinal adjustment bar 60. The horizontal extension 58 of the bar 60 is attached to the first leg section 16 through a vertical bar 62, and the extension 58 is slidably received within an aperture in each of the collars 56. Conventional means may be provided for locking the bar 60 against movement through the collar when the extension 58 has been located at a desired position.

In order to effect the movements of the table sections illustrated in FIGS. 1–4, the collar 56 is first released to permit movement of the collar downwardly along the vertical extension 54 thus lowering the bar 60 and the leg sections 16, 18, as illustrated in FIG. 2. With the collars 56 thus in position, the extensions 58 are released to permit rearward movement of the extensions 58 through the collars 56 to bring the first leg-section 16 into overlapping relationship underneath the seat section 22, as illustrated in FIG. 3. During this step, the second leg section 18 may also be pivoted downwardly to a position adjacent to the base 12. Finally, the seat and back portions are moved forwardly through the cooperating engagement of the rails 42 within the recesses 44 until the forward edge 30 of the seat section 22 is located a desired distance forwardly of the second seat section 18, as is illustrated in FIG. 4.

Figure 6:
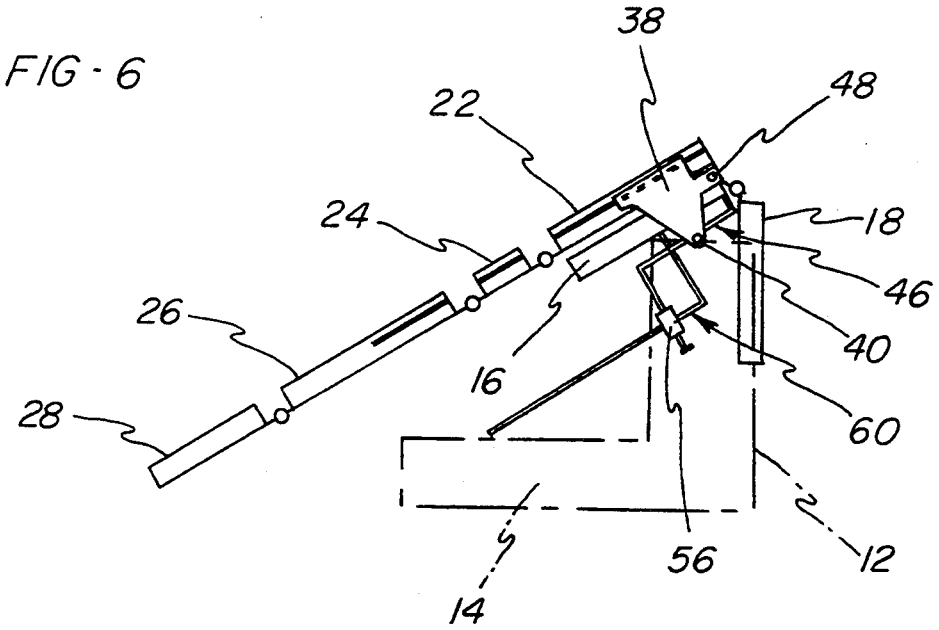
FIG. 6 is a diagrammatic elevational view showing the table in a 30° trendelenburg position.
Figure 7:
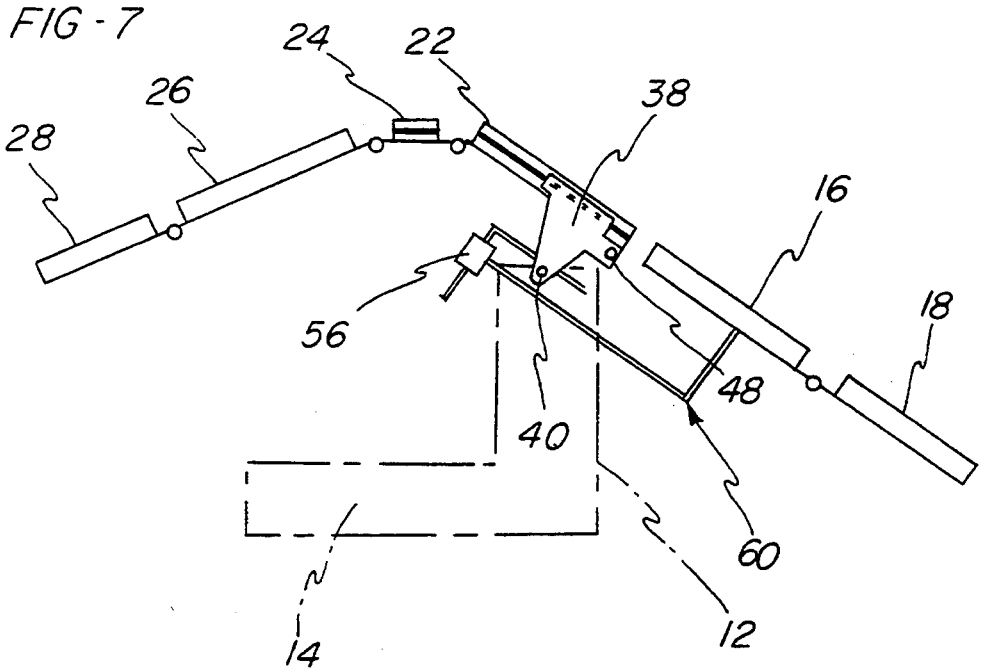
FIG. 7 is a diagrammatic elevational view showing the table in position for a kidney or thoracic operation.
Figure 8:
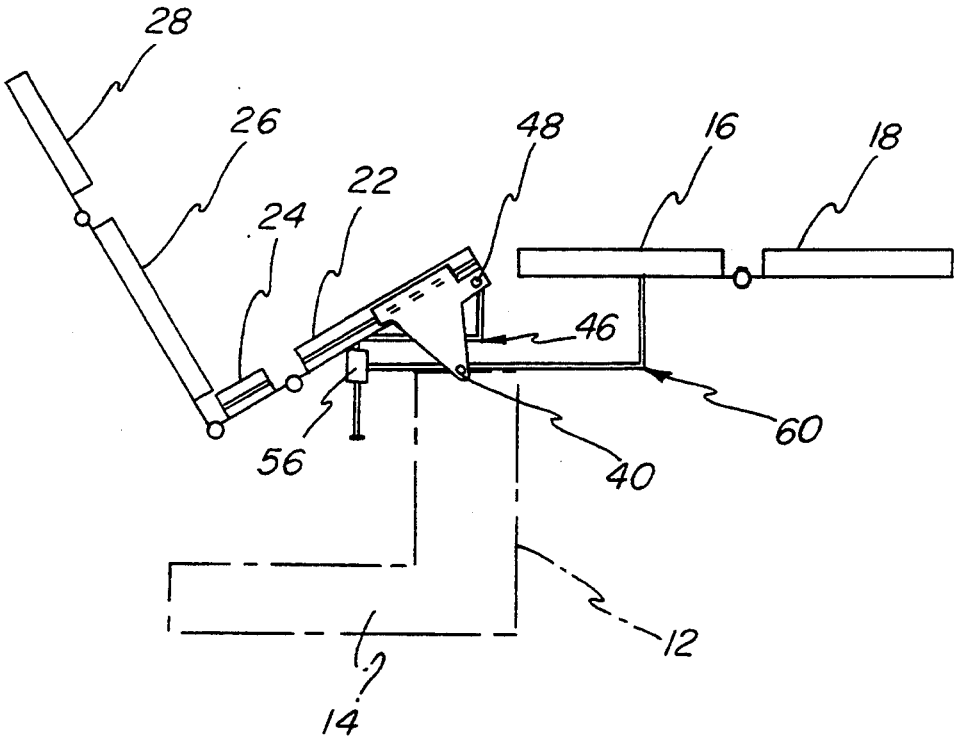
FIG. 8 Is a diagrammatic elevational view showing the table configured to support the patient in a sitting position.

FIGS. 6–8 illustrate further configurations of the table intended to accommodate different specialized surgical procedures. FIG. 6 illustrates a jack knife or 30° trendelenburg position. This configuration may be obtained by moving the leg sections to the position shown in FIG. 3 and then pivoting the patient support portion 10 about the pivot points 40 to the desired angular orientation.

FIG. 7 illustrates a configuration of the table for performing a thoracic or kidney operation. To obtain this configuration, the seat section 22 and leg sections 16, 18 may be pivoted about the pivot point 40 to position the patient support portion 10 in a flex position. Further, it should be noted that the kidney elevator section may be adjusted to a desired particular height to facilitate positioning the patient while the table is in this configuration.

FIG. 8 illustrates a configuration for the table which positions the patient in a sitting position. This position may be used for ear, nose and throat surgery, neurology procedures, or for plastic surgery procedures.

In addition, it should be noted that the base member 12 may be provided with means for vertically positioning the patient support portion 10. The vertical positioning means may be of any conventional form including means similar to those disclosed in the KIRSCHNER Chick Surgical Systems brochures described above.

Referring to FIGS. 9–13, an alternative embodiment of the present invention is shown which operates to provide substantially the same positions as disclosed in the embodiment of FIGS. 1–8.

Figure 9:
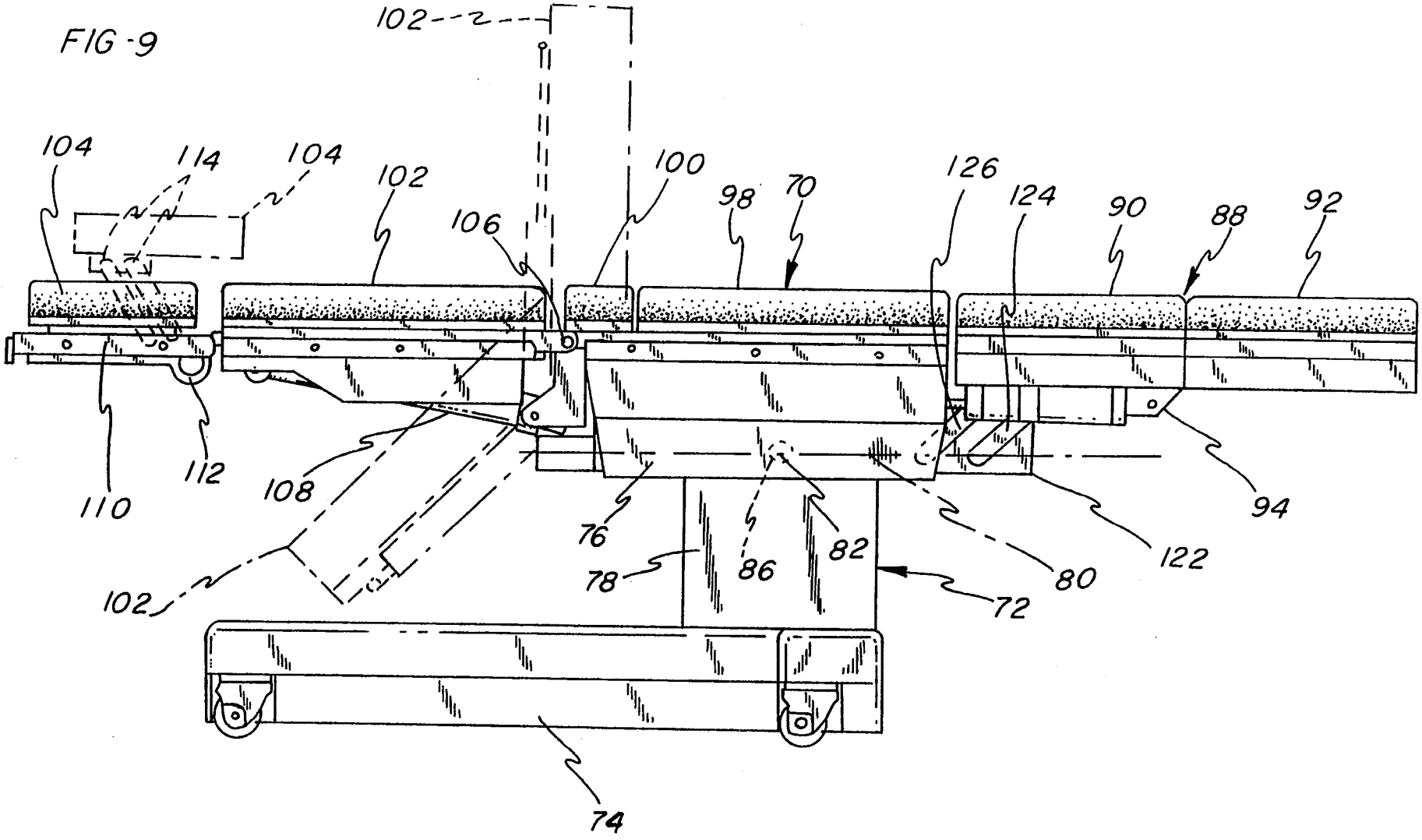
FIG. 9 is a side elevational view showing an alternative embodiment of the present invention configured to support a patient in a supine position, and showing alternative positions for the back section and the headrest.

Referring initially to FIG. 9, the surgery table of the present embodiment includes a patient support portion 70 and a base structure 72 for supporting the patient support portion 70. As in the previous embodiment, the base structure 72 preferably includes an elongated lower section 74, and further includes an upper end 76 which is attached to a column 78. In addition, the upper end 76 is preferably mounted for pivotal movement about a longitudinal axis 80 as well as about a lateral axis 82 (see FIG. 12). For example, the upper end 76 may be attached to the column 78 by means of a longitudinally extending axis shaft 84 and a laterally extending axis shaft 86.

The patient support portion 70 includes a leg portion 88 comprising a first section 90 and a second section 92. The first and second leg sections 90, 92 are connected to each other by a pivot connection 94 whereby the second section 92 may move in pivotal movement relative to the first section 90. As may be seen in FIG. 10, the second section 92 may be actuated for pivotal movement about the pivot connection 94 by means of a cylinder 96 located within the first section 90.

Figure 11:
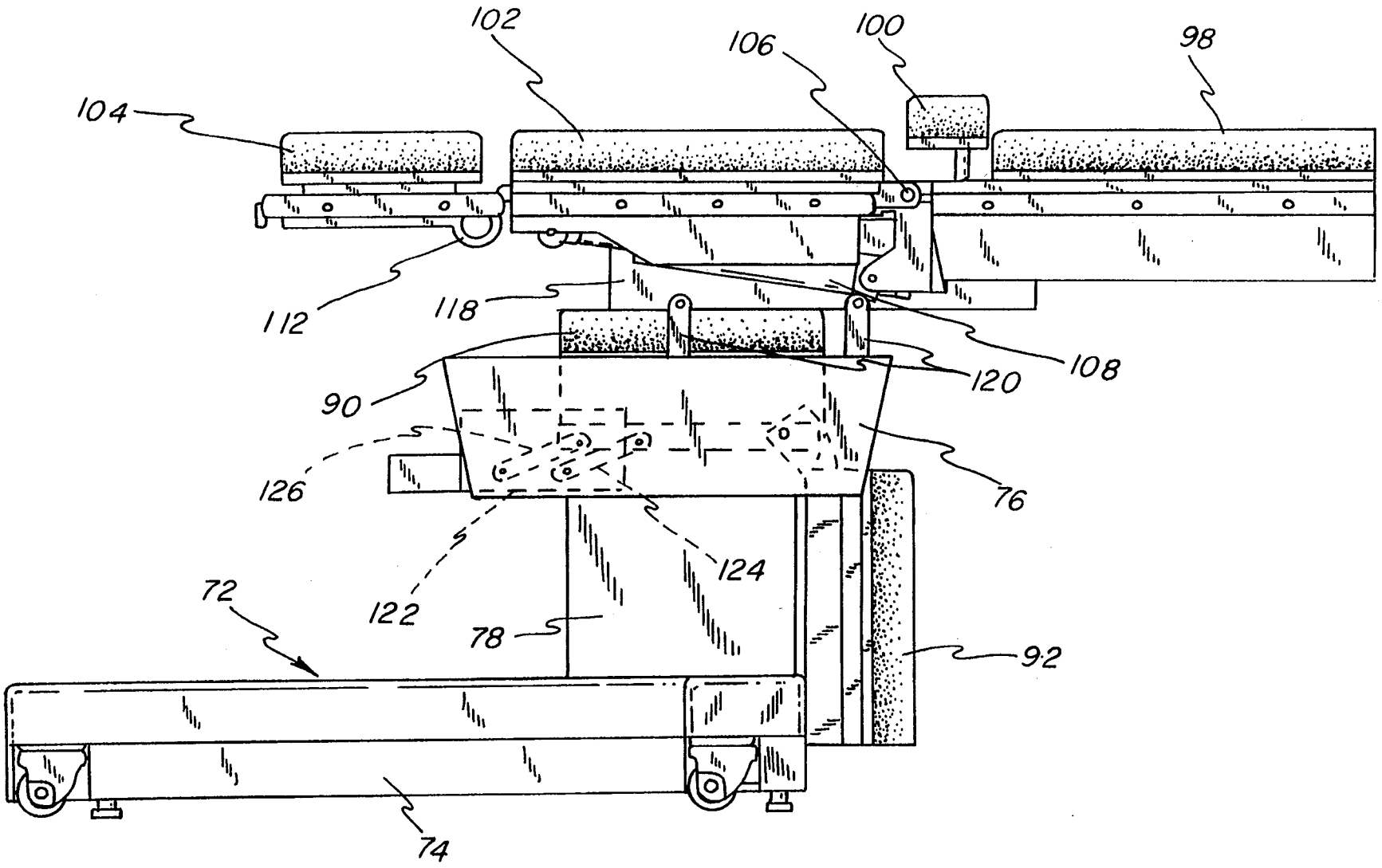
FIG. 11 is a side elevational view of the embodiment of FIG. 9 showing the leg portion in a fully stored position and showing the seat section extended outwardly beyond the foot end of a support frame for the patient support.

Referring to FIG. 9, the patient support portion 70 further includes a seat portion formed by a seat section 98 and a kidney elevator section 100, as well as a back portion including a back section 102 and a headrest or support section 104. The back section 102 is pivotally connected to the seat section 90 at a pivot connection 106 and a cylinder 108 is provided between the seat section 98 and the back section 102 for causing pivotal movement of the back section 102 to both raised and lowered positions, as shown by phantom lines in FIG. 9. In addition, the kidney elevator 100 may be actuated for vertical movement relative to the seat section 98, as shown in FIG. 11.

Referring to FIG. 9, the headrest 104 is mounted to a headrest support 110 which is connected to the back portion 102 at a pivot connection 112 such that the headrest 104 may be pivoted downwardly to lower a patient's head for intubation. In addition, the headrest 104 is mounted to the headrest support 110 by a parallelo-gram linkage 114 whereby the headrest 104 may be moved upwardly parallel to the upper surface of the patient support 70 in order to support a patient's head when the patient is lying on his or her side.

The column 78 is preferably formed as a multiple stage lift mechanism which may be of conventional design. For example, the lift mechanism may be in the form of the retractable column assembly shown in U.S. Pat. No. 4,552,403, which patent is incorporated herein by reference.

An important design consideration for the present surgery table lies in providing a table height which is sufficiently low to avoid impeding access to the table top when a patient is mounting the table, and providing a table wherein the height may be increased to a sufficiently high level to avoid requiring a surgeon to lean over for any particular surgery. Further, as noted above with regard to the embodiment of FIGS. 1–8, it is desirable to provide a surgery table wherein the leg section may be stored underneath the seat section to provide improved access to the patient by a surgeon as well as by standard x-ray equipment such as a C-arm which must be placed such that it extends both above and below the table top.

In the preferred design, the table top is movable from a location approximately two feet above the floor level to a location approximately four feet above the floor level such that it must travel approximately two feet. It has been found that a conventional lift mechanism is not able to provide this extent of travel for the present surgery table as a result of providing a space beneath the seat section 98 in order to accommodate the leg portion 88. In providing this space, while also providing a structure for positioning the table top two feet from the floor level, the size of the lift mechanism has been limited to an extent where it would be difficult to provide the desired lifting to the required upper position for the table top.

Figure 10:
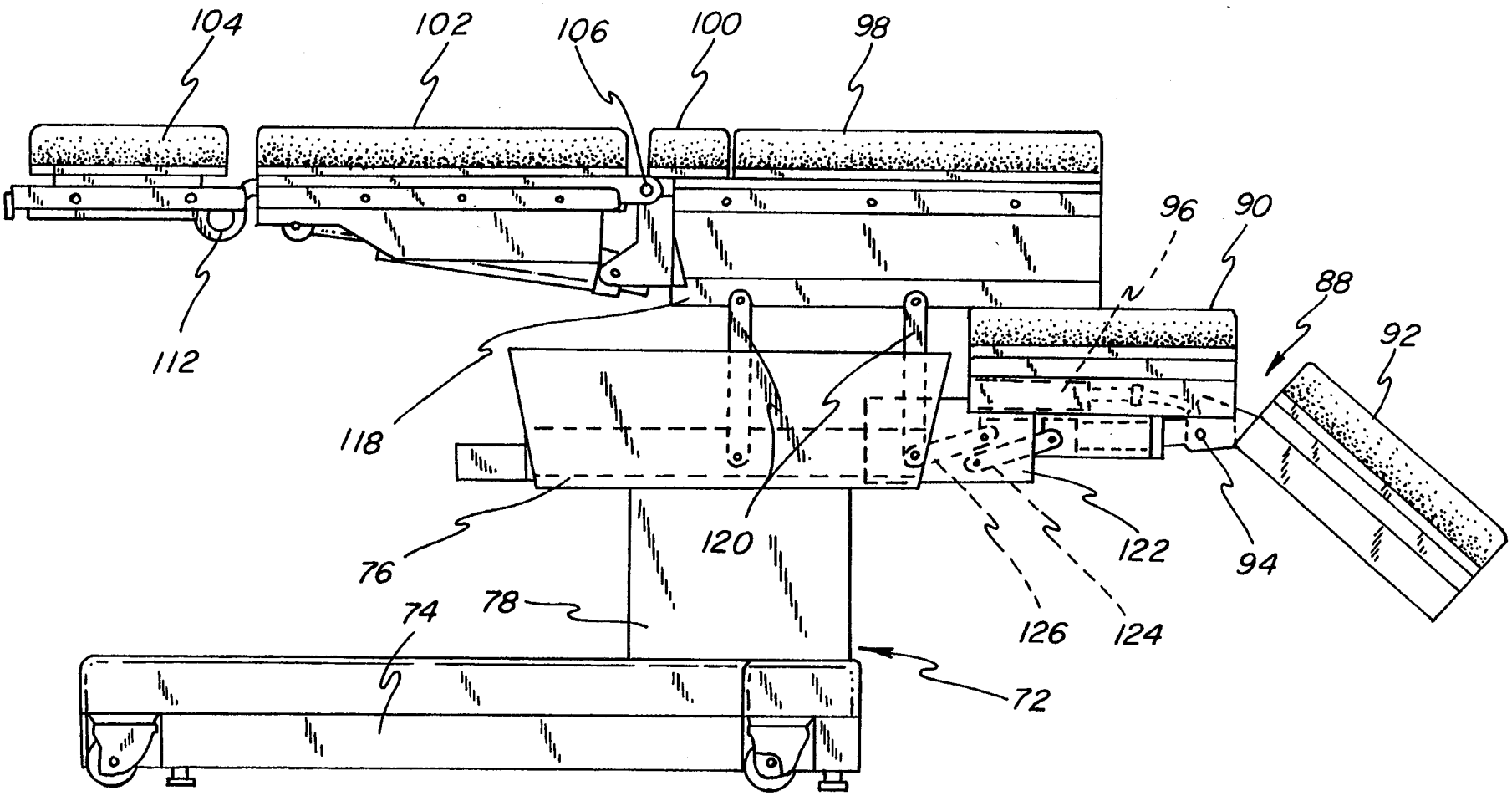
FIG. 10 is a side elevational view showing the embodiment of FIG. 9 with the leg portion partially stored under the seat portion of the table.
Figure 12:
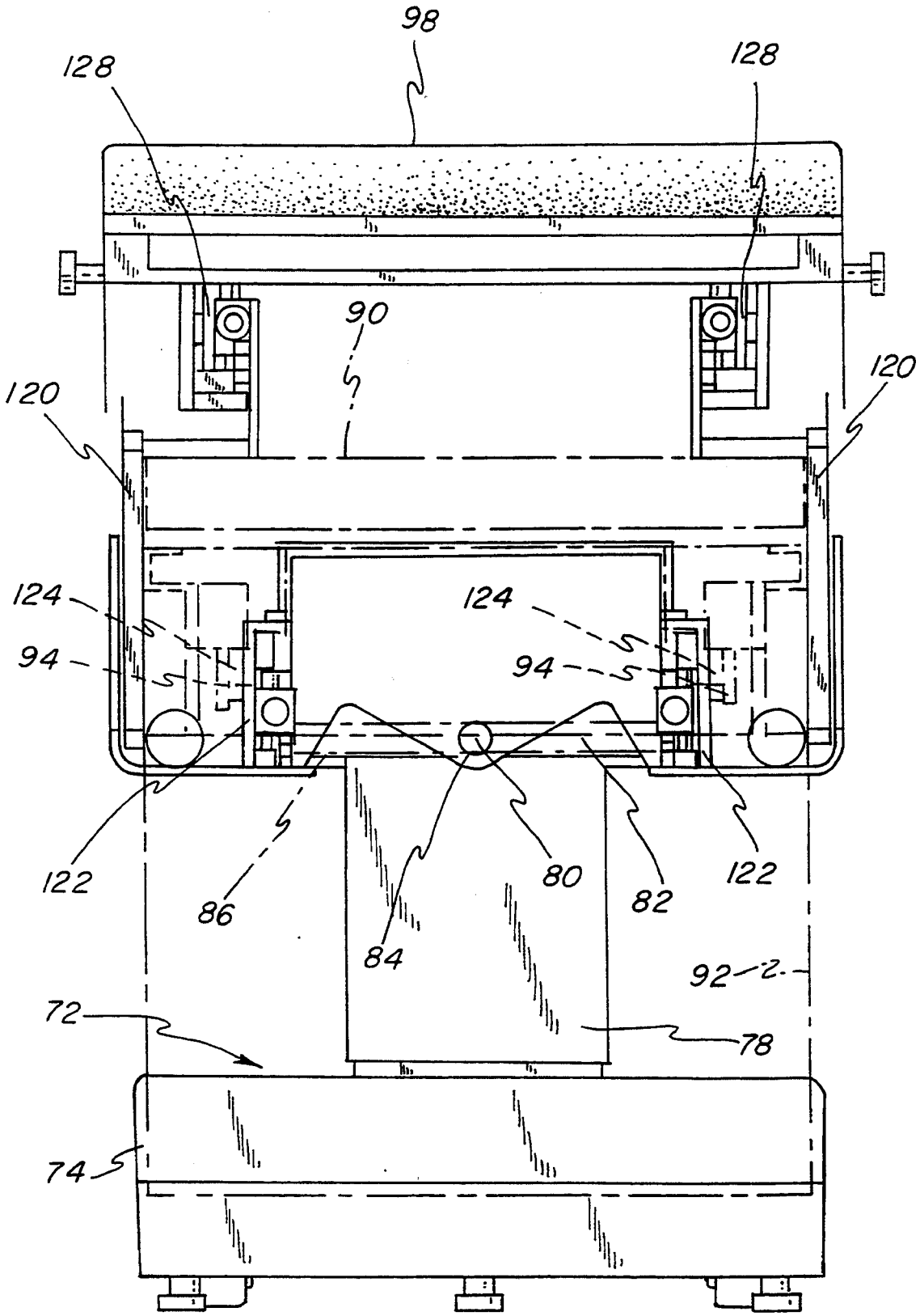
FIG. 12 is an end elevational view of the embodiment of FIG. 9 With the leg portion positioned underneath the seat/section for the table.

In order to provide the additional vertical movement required by the patient support portion 70 as well as to provide a space for storing the leg portion 88, the patient support portion 70 is mounted on a support frame 118 and the support frame 118 is mounted to the upper end 76 of the base structure 72 by means of a parallelogram linkage 120, as shown in FIGS. 10 and 12. Thus, when it is desired to move the leg portion 88 to a stored position, the support frame 118 is moved upwardly relative to the base structure upper end 76 to form a space therebetween for receiving the first section 90 of the leg portion 88. Further, this movement may also be used whenever it is necessary to provide additional height for the patient support portion 70.

A pair of lateral leg support mounting members 122 mount the leg portion 88 to the upper end 76 of the base structure 72. The leg portion 88 is connected to the mounting members 122 by means of a pair of front pivot links 124 and a pair of rear pivot links 126. The pairs of links 124, 126 form a parallelogram linkage whereby the leg portion 88 may be moved in a vertical direction while remaining parallel to the upper surface of the seat section 98.

In order to move the leg portion 88 to its position between the seat section 98 and the upper end 76 of the base structure 72, the mounting members 122 are mounted for sliding movement on the upper end 76 whereby the mounting members may be moved longitudinally toward the head end of the surgery table to the position shown in FIG. 11. In order to facilitate movement of the mounting members 122, the mounting members 122 are preferably guided for movement through the upper end 76 by low friction bearing surfaces such as castors (not shown).

It should be noted that with the first leg section 90 positioned within the space in the upper end 76 of the base structure 72 and the second section 92 pivoted downwardly such that it extends parallel to the column 78, the maximum amount of space possible is provided beneath the patient support structure 70 to thereby facilitate access to the area below the patient support structure 70 for positioning x-ray equipment.

In addition, the patient support portion 70 is movable longitudinally relative to the support frame 118 and may be supported on a support structure 138 including castors for smooth sliding movement. Further, the seat portion 98 may be moved in a direction toward the foot end of the table such that it is in cantilever relationship to the support frame 118 with the back section 102 forming the main area of contact between the patient support portion 70 and the foot end of the support frame 118, as best shown in FIG. 11. In addition, it should be noted that the location of the patient support portion 70 shown in FIG. 11 positions the seat section 98 such that the perineal cut-out located at the foot end thereof is positioned well away from the foot end of the support frame 118 such that a surgeon may work in this area without being obstructed by the support structure.

Figure 13:
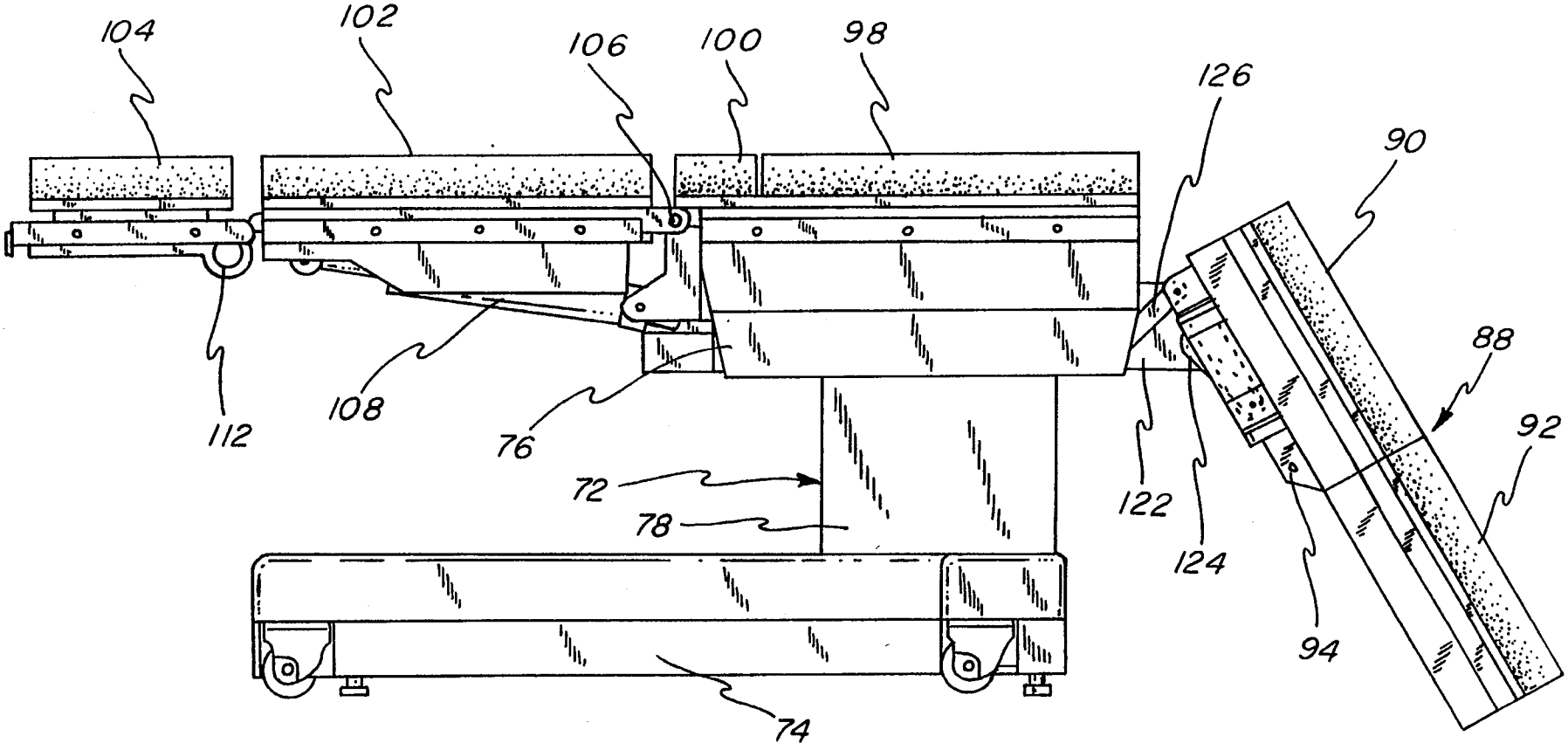
FIG. 13 is a side elevational view of the embodiment of FIG. 9 wherein the leg portion has been pivoted downwardly to an angle relative to the seat section.

Referring to FIG. 13, downward pivotal movement of the leg portion 88 relative to the mounting members 122 is illustrated. The pivoted movement shown in FIG. 13 is accomplished by providing fixed pivot points for the connection between the links 124, 126 and the mounting members 122 and by providing a slidable mounting point between the front links 124 and the attachment point on the first leg section 90. Thus, by maintaining the link 126 in a fixed position and sliding the connection between the link 124 and the first section 90 toward the pivot connection 94, the leg portion 88 is caused to pivot downwardly relative to the seat section 98.

It should be noted that the various movements for the different sections of the surgery table of the present embodiment may be accomplished by providing conventional actuation cylinders or other power actuating means (not shown). Further, it is contemplated that programmable control means (not shown) may be provided for automatically moving the different sections of the table to preselected positions in order to accommodate various specific surgery positions for the present surgery table.

From the above description of the present invention, it should be apparent that the surgical table described provides a patient support surface which may be configured to a plurality of orientations for the performance of various standard surgical procedures. In addition, the present surgical table provides a support surface wherein the patient may be positioned on the table with the patient's head positioned on the headrest and wherein the leg support portions of the table may be conveniently moved to a non-interfering location and the seat portion supporting the patient may be moved to a location which permits full access of the surgeon and any necessary equipment for performing the surgery.

While the form of apparatus herein described constitutes a preferred embodiment of the invention, it is understood that the invention is not limited to this precise form of apparatus, and that changes may be made therein without departing from the scope of the invention, which is defined in the appended claims.

What is claimed is:

1. A surgery table for providing improved access to a patient, said table comprising:

a base structure including a support frame having a head end and a foot end and defining a longitudinal axis, a seat section including means for engaging said support frame, said seat section being supported for longitudinal movement parallel to said longitudinal axis, a leg portion mounted adjacent to said seat section, means for guiding said leg portion longitudinally relative to said support frame to a storage position below said support frame, and wherein said seat section is mounted for movement beyond said foot end of said support frame to provide improved access to a patient positioned on said seat section.

2. The surgery table of claim 1 including cooperating linkage members mounted for simultaneous pivotal movement to guide said leg portion in vertical movement while maintaining an upper surface of said leg portion in a horizontal plain, said linkage members further being movable independently of each other to move said leg portion to a downwardly tilted orientation.

3. The surgery table of claim 1 wherein said seat section is pivotable about said longitudinal axis.

4. The surgery table of claim 1 including a perineal cut-out in said seat section adjacent to said leg section, said perineal cut-out being movable to a position longitudinally spaced from said support frame during longitudinal movement of said seat section.

5. A surgery table for providing improved access to a patient, said table comprising:

a base structure including a support frame having a head end and a foot end and defining a longitudinal axis, a seat section including means for engaging said support frame, said seat section being supported for longitudinal movement parallel to said longitudinal axis, a leg portion mounted adjacent to said seat section, means for guiding said leg portion to a storage position below said support frame, and wherein said seat section is mounted for movement beyond said foot end of said support frame to provide improved access to a patient positioned on said seat section, said base structure further including a column supporting said support frame, said support frame being movable relative to said column to form a storage area for said leg portion when said leg portion is in said storage position.

6. The surgery table of claim 5 including means for adjusting the height of said column.

7. A surgery table for providing improved access to a patient, said table comprising:

a base structure including a support frame having a head end and a foot end and defining a longitudinal axis, a seat section including means for engaging said support frame, said seat section being supported for longitudinal movement parallel to said longitudinal axis, a leg portion mounted adjacent to said seat section, means for guiding said leg portion to a storage position below said support frame, and wherein said seat section is mounted for movement beyond said foot end of said support frame to provide improved access to a patient positioned on said seat section, said base structure including a column supporting said support frame and said leg portion including first and second leg sections, said first leg section extending between said column and said support frame and said second leg section extending down along a side of said column when said leg portion is in said storage position.

8. A surgery table for providing improved access to a patient, said table comprising:

a base structure including a support frame having a head end and a foot end and defining a longitudinal axis, a seat section including means for engaging said support frame, said seat section being supported for longitudinal movement parallel to said longitudinal axis, a leg portion mounted adjacent to said seat section, means for guiding said leg portion to a storage position below said support frame, wherein said seat section is mounted for movement beyond said foot end of said support frame to provide improved access to a patient positioned on said seat section, and a back section mounted in pivotal relation to said seat section, said seat and back sections being movable to a first position with said support frame engaging and supporting said back section and with said seat section located in longitudinally spaced relation to a foot end of said support frame, and said seat and back sections being movable to a second position with said support frame engaging and supporting said seat section and with said back section located in longitudinally spaced relation to a head end of said support frame.

9. The surgery table of claim 8 wherein said back section is adapted to pivot below said seat section.

10. A surgery table for providing improved access to a patient, said table comprising:

a base structure including a vertical column and a support frame attached to an upper end of said column;

a patient seat and back support portion supported on said support frame;

means for moving said upper end of said column relative to a lower end of said column to alter the vertical position of said patient seat and back support portion, and means for mounting said support frame in a generally horizontal plane and for guiding said support frame in vertical movement relative to said upper end of said column while maintaining said support frame parallel to said generally horizontal plane to further alter the vertical height of said patient seat and back support portion.

11. The surgery table of claim 10 including a leg portion mounted for movement to a location between said support frame and said upper end of said column.

12. The surgery table of claim 11 including cooperating linkage members mounted for simultaneous pivotal movement to guide said leg portion in vertical movement while maintaining an upper surface of said leg portion in a horizontal plane, said linkage members further being movable independently of each other to move said leg portion to a downwardly tilted orientation.

13. The surgery table of claim 10 wherein said means for mounting said support frame comprises a parallelogram linkage.

14. The surgery table of claim 10 wherein said patient seat and back support portion is mounted for horizontal movement relative to said support frame in a longitudinal direction.

15. The surgery table to claim 14 wherein said patient seat and back support portion includes a seat section and a back section mounted in pivotal relation to each other, said patient seat and back support portion being movable to a first portion with said support frame engaging and supporting said back section and with said seat section located in longitudinally spaced relation to a foot end of said support frame, and said patient seat and back support portion being movable to a second position with said support frame engaging and supporting said seat section and with said back section located in longitudinally spaced relation to a head end of said support frame.

16. The surgery table of claim 10 wherein said patient seat and back support portion includes a seat section and a back section, said back section being pivotally mounted for downward pivoting movement in relation to said seat section.

17. The surgery table of claim 16 including a kidney riser located between said seat section and said back section, said kidney riser being vertically movable relative to said seat and back sections.

18. The surgery table of claim 10 including a head support mounted at an end of said patient seat and back support portion by means of a parallelogram linkage.

19. A surgery table for providing improved access to a patient, said table comprising:

a base structure including a vertical column and a support frame attached to an upper end of said column;

a patient support portion supported on said support frame;

means for moving said upper end of said column relative to a lower end of said column to alter the vertical position of said patient support portion, means for moving said support frame relative to said upper end of said column to further alter the vertical height of said patient support portion, and a leg portion mounted for movement to a location between said support frame and said upper end of said column;

said leg portion being supported on said upper end of said column by a parallelogram linkage.

* * * * *